US006136757A

United States Patent [19]

Chiddick

[11] Patent Number: 6,136,757

[45] Date of Patent: Oct. 24, 2000

[54] SOLID LUBRICANTS AND FRICTION MODIFIERS FOR HEAVY LOADS AND RAIL APPLICATIONS

[75] Inventor: Kelvin Chiddick, British Columbia, Canada

[73] Assignee: Kelsan Technologies Corporation, North Vancover, Canada

[21] Appl. No.: 09/269,261

[22] PCT Filed: Sep. 11, 1997

[86] PCT No.: PCT/CA97/00658

§ 371 Date: Jun. 22, 1999

§ 102(e) Date: Jun. 22, 1999

[87] PCT Pub. No.: WO98/13445

PCT Pub. Date: Apr. 2, 1998

[30] Foreign Application Priority Data

Sep. 25, 1996 [CA] Canada ..... 2186419

[51] Int. Cl.[7] ..... C10M 173/02; C10M 125/00

[52] U.S. Cl. ..... 508/126; 508/127; 508/167; 508/169

[58] Field of Search ..... 508/126, 127, 508/167, 169

[56] References Cited

U.S. PATENT DOCUMENTS

| | | | |
|---|---|---|---|
| 2,258,202 | 10/1941 | Barns | 508/126 |
| 2,619,458 | 11/1952 | McBride | 508/169 |
| 3,522,177 | 7/1970 | Benz | 508/126 |
| 3,801,504 | 4/1974 | Stone et al. | 252/23 |
| 3,826,743 | 7/1974 | Kohls et al. | 508/167 |
| 3,843,529 | 10/1974 | Betrand | 508/126 |
| 3,874,862 | 4/1975 | Bickling, Jr. et al. | 508/126 |
| 3,915,870 | 10/1975 | Brown | 508/127 |
| 4,052,323 | 10/1977 | Feneberger et al. | 508/127 |
| 5,173,204 | 12/1992 | Chiddick et al. | 252/30 |
| 5,308,516 | 5/1994 | Chiddick | 252/30 |
| 5,492,639 | 2/1996 | Schneider et al. | 252/30 |
| 5,661,116 | 8/1997 | Periard | 508/126 |

FOREIGN PATENT DOCUMENTS

| | | |
|---|---|---|
| 0 412 788 A1 | 2/1991 | European Pat. Off. . |
| 1048884 | 11/1996 | United Kingdom . |

*Primary Examiner*—Jacqueline V. Howard
*Attorney, Agent, or Firm*—Morgan, Lewis & Bockius LLP

[57] ABSTRACT

The present invention relates to novel lubricant compositions comprising a solid lubricant and a binding agent in water medium suitable for lubricating steel-steel interfaces such as tractor-trailer couplings, rail-wheel systems and other heavy duty applications. The invention also relates to compositions described above which include friction modifiers with high or very high and positive coefficients of friction such that the coefficient of friction is considerably higher than the solid lubricant. The invention further relates to compositions comprising a binding agent and a friction modifier with a very high and positive coefficient of friction in a water medium.

28 Claims, No Drawings

SOLID LUBRICANTS AND FRICTION MODIFIERS FOR HEAVY LOADS AND RAIL APPLICATIONS

This application is a 371 of PCT/CA/97/00658 filed Sep. 11, 1997.

FIELD OF THE INVENTION

The present invention relates to novel lubricant and friction modifier compositions comprising a solid lubricant, or a friction modifier, or both along with a binding agent in water medium suitable for lubricating steel-steel interfaces such as tractor-trailer couplings, rail-wheel systems and other heavy duty applications.

The invention also relates to compositions described above which include friction modifiers with high or very high and positive coefficients of friction such that the coefficient of friction is considerably higher than the solid lubricant.

The invention further relates to compositions comprising a binding agent and a friction modifier with a very high and positive coefficient of friction in a water medium.

BACKGROUND OF THE INVENTION

A conventional lubricant for tractor-trailer couplings, rail-wheel systems and other heavy duty applications is grease. However, grease has serious limitations for operation and for environmental contamination. Following mating of the coupling components after an application of grease, a large portion of the grease is immediately lost due to difficulties of the grease adhering to the coupling or rail. The lost grease falls on parts of the vehicle piping and on the ground as a non-biodegradable contaminant. Further, grease dissipates during use causing its lubricating performance to deteriorate to potentially hazardous conditions. This known dissipation thereby encourages users to apply excessive amounts of grease to compensate. Moreover, exposed couplings, rails or wheels can become contaminated with dust and grit thereby forming a grinding compound which causes rapid wear to the bearing plates unless they are cleaned and regreased before use.

Typically, grease is reapplied every week or two. Its removal prior to regressing is accomplished with high pressure steam causing it to be flushed into the water supply. Alternatively, stronger solvents may be used to remove grease which are even more unacceptable from an environmental standpoint.

Lubricant compositions comprising, inter alia, solid lubricants and polymer media have been used as alternatives to grease and these lubricants have the advantage of forming a film on the metal surface, and accordingly, better adhesion. However, as the lubricant dissipates, the polymer medium may still contaminate the environment.

Aqueous lubricant compositions have been suggested but discarded as impractical in Swiss patent specification CH 669,207 A5, wherein a method of using an aqueous graphite dispersion for coating or painting sides of rails was discussed and discarded as the aqueous dispersion is apparently easily removed. The solution of CH 669,207 A5 is a composition which includes, inter alia, a polymer resin which has the same drawbacks as other polymer media as discussed above.

It is recognized in U.S. Pat. Nos. 5,173,204 and 5,308,516, that when the co-efficient of friction increases with speed, it is known as having a negative friction characteristic. The origin of much noise emission in steel rail-wheel transportation systems can be directly attributed to the fact the negative friction characteristic that under certain conditions arising in use, the wheels of such systems do not always roll over the rails but sometimes slide relative to them. This is most pronounced on curves. An effective way to eliminate the squeaking and chattering is by changing the friction characteristic from a negative one to a positive one. Hereinafter, the term "positive friction" means that the coefficient of friction increases with speed of sliding and a "high" coefficient of friction is greater than 0.10.

Apart from reduced friction (and noise) and wheel-rail wear, use of a friction modifier can prevent the initiation and growth of short pitch corrugation by preventing or eliminating the oscillatory motions, commonly known as roll-stick oscillations, which are excited in the rail/wheel interface by the presence of negative friction.

U.S. Pat. Nos. 5,173,204 and 5,308,516, teach that in a rail-wheel system, the lubricant composition should be applied to 25% all the wheels of a rail-wheel system. Considering that the effect is most pronounced on curves, a lot of lubricant, time and effort is required in order to ensure that there is sufficient lubricant.

SUMMARY OF THE INVENTION

The present invention provides water-based lubricant and friction modifier compositions for heavy duty use with metal applications such as tractor-trailer couplings or rail-wheel systems that has improved adhesion characteristics. The inclusion of a binding agent, defined below, in the lubricant, or lubricant and friction modifier, composition helps to bind the lubricant and friction modifier to the coupling, rail or other surface. Therefore, the composition need not be applied as frequently or in the same quantity and accordingly there will be less lubricant and friction modifier lost and less environmental contamination.

In another aspect, the invention also provides a water-based lubricant composition which includes a wetting agent. The inclusion of a wetting agent also helps to ensure that there is better adhesion of the solid lubricant to the coupling, rail or other surface and thus the solid lubricant may be better applied.

This invention is also directed to water based friction modifier compositions that include a wetting agent.

In another aspect, the invention also provides a water-based lubricant composition which may be applied to a rail at precise areas identified as problem areas such as curves or inclines. Due to this specific application at identified spots, the subsequent transfer from rail to wheel means that the lubricant will be spread along the rail by movement of the wheels over the rail but principally for the identified spots. The advantages of such precision application are that less lubricant, time and effort are required in order to achieve the same results of improved noise control, traction and reduced short pitch corrugation.

In yet a further aspect, the invention provides a lubricant composition which is easier to apply than previous compositions. The lubricant composition is water-based which makes it easier to apply as the binding agent absorbs the water present in the composition and thus allows for quick adhesion to the metal surface.

In one aspect of this invention, the composition comprises:

(a) at least about 24% by weight water medium;

(b) about 8% by weight binding agent; and (c) at least about 2% by weight solid lubricant.

In another aspect the lubricant composition additionally includes a friction modifier which exhibits improved high and positive or very high and positive friction characteristics. The composition allows for the solution to the steel-steel rolling-sliding situation described above with respect to the prior patents U.S. Pat. Nos. 5,173,204 and 5,308,516 but with the added benefit of the precision application, described above, namely, that less lubricant, time and effort will be required to achieve the same result set out in those patents.

Accordingly, in a further aspect, the invention provides a lubricant composition comprising a water medium, solid lubricant, binding agent and a friction modifier present such that the coefficient of friction produced between steel bodies in rolling-sliding motion lubricated using the said composition is greater than 0.10 and wherein said coefficient of friction increases with an increase in the relative speed of sliding movement between the bodies.

According to a further aspect of the invention there is provided a composition comprising:

(a) at least 60% by weight water;

(b) at least 5% by weight binding agent; and (c) at least 3% by weight friction modifier;

wherein the composition has the characteristics of very high and positive friction, with a coefficient of friction ranging from 0.45 at 2.5% creep up to 0.72 at 30% creep. This product is used mainly to enhance traction of the locomotion wheels.

Further, according to the present invention, there is a method of reducing noise in a steel rail-wheel system by applying said lubricant, or lubricant and friction modifier, composition to the surface of the rail whereby the lubricant composition is effective to change the negative friction characteristics between the rail and the wheel to a positive friction characteristic.

The present invention also provides compositions which are capable of effectively reducing short pitch corrugation. This is achieved by compositions having a high coefficient of friction and positive friction characteristics.

The above compositions have the advantage of being relatively non-polluting and economical in that the dispersal means allows for isolated application of compositions to surfaces which are targeted as problem areas.

DETAILED DESCRIPTION OF THE SPECIFIC EMBODIMENTS OF THE INVENTION

Generally the lubricant and friction modifier compositions are water-based compositions consisting of water, a solid lubricant, as required, a binding agent and, in some embodiments, a friction modifier and/or a wetting agent.

The lubricant and friction modifier compositions can be formulated by selecting one or more solid lubricants and friction modifiers as required. Examples of solid lubricants and friction modifiers can be found from, but are not limited to, the following lists.

Solid Lubricants molybdenum disuphide
graphite
aluminum stearate
zinc stearate
carbon compounds (coal dust, carbon fibres, etc.)

The preferred solid lubricants are molybdenum disulphide and graphite.

Friction Modifiers calcium carbonate
magnesium carbonate
magnesium silicate
barium sulphate
calcium sulphate
asbestos
aluminum silicate
silica
amorphous silica
naturally occurring silica
slate powder
diatomaceous earth
ground quartz
silica flour
white lead
basic lead carbonate
zinc oxide
antimony oxide
dolomite
calcium sulphite
napthalene synemite
polyethylene
mica The friction modifier, if any, preferably comprises a powderised mineral. The friction modifier for a high and positive friction lubricant composition may have a particle size in the range of about 0.5 microns to about 5 microns, and preferably has a particle size in the range of about 1 micron to about 2 microns. A very high and positive friction modifier composition may have a particle size of 10 microns.

The friction modifier should have a coefficient of friction which is considerably higher than the coefficient of friction of the solid lubricant. The coefficient of friction values given are those produced between steel bodies in rolling-sliding contact. High and positive friction modifier compositions produce a coefficient of friction which is greater than 0.10 and wherein the said coefficient of friction increases with an increase in the relative speed of sliding movement between steel bodies. For example, which is not to be considered limiting in any manner, the coefficient of friction of the composition of the present invention may range from about 0.17 to about 0.35 as creepage levels increase from about 2.5% to about 30% between steel bodies in rolling-sliding contact. For very high and positive friction, the steel to steel coefficient of friction for the lubricant composition according to the invention should increase from about 0.45 to about 0.72 as creepage increases from about 2.5% to about 30%. Particular compositions contain friction modifiers but not solid lubricants to create very high and positive friction characteristics.

The term binding agent herein is defined to mean a hydrophilic agent which absorbs water causing it to swell out physically into particles of a shape capable of adhering to a rail. The binding agent creates a continuous phase matrix which is capable of binding solid lubricants, friction modifiers and other compounds to a metallic surface by dispersing the solid lubricant or holding said solid lubricant in a discontinuous phase matrix. The binding agent has rigidity such that when the composition is placed on the metal surface, it has some structure and will maintain its integrity after the wheel goes over the composition. Examples of binding agents include but are not limited to clays such as bentonite (sodium montmorillonite) and casine.

Also optionally are included preservatives, wetting agents and additives to allow for mixing of the composition with grease already on rail or coupling. Preservatives such as ammonia are used for preserving the lubricant composition. Alcohols such as butoxyethanol may also be used.

The term wetting agent used herein is defined to mean a flow agent which permits the solid lubricant particles to be surrounded by water within the matrix of the binding agent and the solid lubricant. The wetting agent helps to reduce surface tension and allows the solid lubricant to get into the cracks of the rails or other surfaces and also emulsifies the grease to permit a good adhesion. An example of a wetting agent includes but is not limited to nonyl phenoxypolyol.

Method of Preparation

Embodiments of the lubricant and friction modifier compositions may be prepared according to the following method. Under a high speed mixer slowly add to 35% of the water in a mixing drum at room temperature, the binding agent (ie. Bentonite (sodium montmorillonite)) and the wetting agent (ie. nonyl phenoxypolyol). These components should be mixed well until thick gel is formed. Continue to mix then add the balance of ingredients in the following order: water (the remaining 65%), ammonia, ether E.B. (if any), any other liquids, solid lubricant (ie. molybdenum)as required, and any other solids. These components should be mixed thoroughly until smooth to ensure that the solid lubricant is well dispersed.

The resulting composition is a thick, thixotropic liquid which is jelly-like when standing but upon stirring or pumping the viscosity decreases. The composition is a matrix whose continuous phase is the binding agent and which also contains a discontinuous phase, the solid lubricant.

The above compositions may be applied to the coupling or rail surfaces or the like by means of which will be recognized by one in the art such as pump or brush. The composition is applied so that a film of the composition is evenly spread on the rail. Said film is preferably a bead approximately one-eighth of an inch in diameter.

The binding agent works by absorbing the water in the composition. Over time the composition dehydrates to leave a solid bead and thereby enhances adhesion of the lubricant and friction modifier to the rail over previously used greases or polymer lubricant compositions. The binding agent additionally keeps the lubricant and friction modifier dispersed even after the wheel runs over the rail and also reduces reabsorption of water. Therefore, the composition is not easily removed by rain.

The desired coefficient of friction level for the compositions of this invention are obtained by proportionately mixing appropriate quantities of the friction modifier with a high coefficient of friction and the solid lubricant with a very low coefficient of friction. The solid lubricant and the friction modifier are preferably present in the composition in about equal amounts for the high and positive friction compositions but may be present in differing amounts or with no solid lubricant in order to achieve very high and positive friction characteristics.

The following, given by way of example only and not intended to be construed in a limitative manner, illustrate the compositions according to embodiments of the invention.

EXAMPLE 1

A water-based, high and positive friction lubricant composition comprises:

(a) 80.193% by weight water;

(b) 8.940% by weight sodium montmorillonite;

(c) 0.004% by weight ammonia;

(d) 0.002% by weight nonyl phenoxypolyol;

(e) 4.930% by weight molybdenum disulphide; and (f) 4.93% by weight magnesium silicate;

and is prepared as described above.

A North American heavy haul railroad tested the above composition and it was found that noise levels were reduced by 20 decibels at the top of the rail and at the gage face.

Similar lubricant compositions can be formulated by selecting one or more alternative lubricants and friction modifiers as disclosed above.

EXAMPLE 2

A water-based, very high and positive friction composition (with no added lubricant) was prepared as described above using the following components:

(a) 85.254% by weight water;

(b) 9.450% by weight sodium montmorillonite;

(c) 0.004% by weight ammonia;

(d) 0.002% by weight nonyl phenoxypolyol;

(e) 5.20% by weight anydrous aluminum silicate; and (f) 0.09% by weight black iron oxide (as a colorant)

The composition was tested and found to produce a positive steel to steel friction characteristic in the range of 0 to 0.45 as the relative speed of sliding (creepage) increased from zero to about 2.5%, rising to about 0.72 as creepage increased to about 30%. These coefficient of friction levels are substantially above steel to steel friction coefficient levels obtained with conventional lubricants and above those of the lubricant composition disclosed in U.S. Pat. Nos. 5,173,204 and 5,308,516.

EXAMPLE 3

A water-based 5th wheel lubricant composition was prepared as described above using the following components:

(a) 58.994% by weight water;

(b) 8% by weight sodium montmorillonite;

(c) 0.004% by weight ammonia;

(d) 0.002% by weight nonyl phenoxypolyol;

(e) 3% by weight butoxyethanol; and (f) 30% by weight molybdenum disulphide.

When the lubricant was applied to the surface of a wheel tread, the composition illustrated a marked improvement with respect to adhesion of the lubricant. Tests have shown that the fifth wheel composition lasts substantially longer or for substantially more miles, in the order of 5–10 times longer than conventional lubricants.

EXAMPLE 4

A water-based low coefficient friction lubricant composition was prepared as described above using the following components:

(a) 79.502% by weight water;

(b) 12.621% by weight sodium montmorillonite;

(c) 0.004% by weight ammonia;

(d) 0.002% by weight nonyl phenoxypolyol;

(e) 3% by weight butoxyethanol; and (f) 4.871% by weight molybdenum disulphide.

Similar testing was done to that described in example 1 and with similar results being recorded.

It is understood that the invention has been disclosed herein in connection with certain examples and embodiments. However, such changes, modifications or equivalents as can be used by those skilled in the art are intended to be included. Accordingly, the disclosure is to be construed as exemplary, rather than limiting, and such changes within the principles of the invention as are obvious to one skilled in the art are intended to be included within the scope of the claims.

What is claimed is:

1. A water-based lubricant composition for lubricating steel-to-steel interfaces consisting of:

(a) from about 24% to about 88% by weight water;

(b) about 3% to about 15% by weight binding agent;

(c) from about 2% to about 60% by weight solid lubricant; and (d) a wetting agent.

2. The composition according to claim 1, wherein the solid lubricant is molybdenum disulphide, graphite, or a combination thereof.

3. The composition according to claim 1, wherein the binding agent is sodium montmorillonite.

4. The composition according to claim 1, wherein the wetting agent is nonyl phenoxypolyol.

5. The composition of claim 1 for the use of lubricating steel surfaces.

6. A water-based lubricant composition for lubricating steel-to-steel interfaces consisting of:

(a) from about 60% to about 90% by weight water;

(b) from about 5% to about 18% by weight binding agent;

(c) from about 3% to about 24% by weight solid lubricant; and (d) from about 3% to about 32% by weight friction modifier, wherein said composition is characterized in producing a coefficient of friction of at least 0.1 which increases with increased creepage levels between steel bodies in rolling-sliding contact.

7. The water based lubricant composition of claim 6 further consisting of a wetting agent.

8. The composition according to claim 6, wherein the solid lubricant is molybdenum disulphide, graphite, or a combination thereof.

9. The composition according to claim 6, wherein the friction modifier has a particle size in the range of 0.5 to 5 microns.

10. The composition according to claim 6, wherein the friction modifier has a particle size in the range of 1 to 2 microns.

11. The composition according to claim 6, wherein the binding agent is sodium montmorillonite.

12. The composition according to claim 7, wherein the wetting agent is nonyl phenoxypolyol.

13. The composition of claim 6 for the use of lubricating steel surfaces.

14. A water-based friction modifier composition consisting of:

(a) from about 60% to about 90% by weight water;

(b) from about 5% to about 18% by weight binding agent; and (c) from about 3% to about 32% by weight friction modifier, wherein said composition is characterized in producing a coefficient of friction of at least 0.1 which increases with increased creepage levels between steel bodies in rolling-sliding contact.

15. The water based lubricant composition of claim 14 further consisting of a wetting agent.

16. The composition according to claim 14 wherein the coefficient of friction increases to about 0.45 at creepage levels of up to 2.5%.

17. The composition according to claim 14 wherein the coefficient of friction increases from about 0.45 to about 0.72 as creepage increases from about 2.5% to about 30%.

18. The composition according to claim 14, wherein the friction modifier has a particle size of 10 microns.

19. A water based lubricant composition comprising:

(a) 24–88% by weight water;

(b) 3–15% by sodium montmorillonite;

(c) 2–60% by weight molybdenum disulphide; and (d) 0.002–2% by weight nonyl phenoxypolyol.

20. The water-based lubricant composition of claim 19 comprising:

(a) 55–88% by weight water;

(b) 5–8% by weight sodium montmorillonite;

(c) 2–18% by weight molybdenum disulphide; and (d) 0.002–2% by weight nonyl phenoxypolyol.

21. A water-based lubricant composition comprising:

(a) 60–90% by weight water;

(b) 5–18% by weight sodium montmorillonite;

(c) 3–24% by weight molybdenum disulphide;

(d) 3–24% by weight magnesium silicate; and (e) 0.002–2% by weight nonyl phenoxypolyol wherein said molybdenum disulphide and magnesium silicate are present in a ratio of 1:1 such that the resulting coefficient of friction of the said composition ranges from about 0.17 to about 0.35 as creepage levels increase from about 2.5% to about 30% between steel bodies in rolling-sliding contact.

22. A water-based composition comprising:

(a) 60–90% by weight water;

(b) 5–18% by weight sodium montmorillonite;

(c) 3–32% by weight anhydrous aluminum silicate; and (d) 0.002–2% by weight nonyl phenoxypolyol wherein the resulting coefficient of friction of the said composition ranges from about 0.45 to about 0.72 as creepage levels increase from about 2.5% to about 30% between steel bodies in rolling-sliding contact.

23. The composition according to claim 14, wherein the binding agent is sodium montmorillonite.

24. The composition according to claim 15, wherein the wetting agent is nonyl phenoxypolyol.

25. The composition of claim 14 for the use of lubricating steel surfaces.

26. A method for lubricating a metallic surface to reduce friction and wear, using a lubricant composition according to claim 1 comprising depositing a bead of the lubricant composition onto the metallic surface and allowing the water to evaporate.

27. A method for lubricating a metallic surface to reduce friction and wear, using a lubricant composition according to claim 6 comprising depositing a bead of the lubricant composition onto the metallic surface and allowing the water to evaporate.

28. A method for lubricating a metallic surface to reduce friction and wear, using a lubricant composition according to claim 14 comprising depositing a bead of the lubricant composition onto the metallic surface and allowing the water to evaporate.

* * * * *